United States Patent [19]

Barish et al.

[11] Patent Number: 4,728,210

[45] Date of Patent: Mar. 1, 1988

[54] PACKAGE AND APPLICATOR FOR SOLID PRODUCT

[75] Inventors: Robert A. Barish, Trenton; Frederick G. Searby, Freehold, both of N.J.

[73] Assignee: Carter-Wallace, Inc,

[21] Appl. No.: 905,532

[22] Filed: Sep. 10, 1986

[51] Int. Cl.[4] ..... A46B 5/02

[52] U.S. Cl. ..... 401/6

[58] Field of Search ..... 401/6; 132/88.5, 83

[56] References Cited

U.S. PATENT DOCUMENTS

| | | | |
|---|---|---|---|
| 445,701 | 2/1891 | Lee . | |
| 448,197 | 3/1891 | Beutelspacher . | |
| 562,033 | 6/1896 | Rounds . | |
| 1,027,208 | 5/1912 | Manheim . | |
| 1,255,985 | 2/1918 | Chatfield . | |
| 1,333,941 | 3/1920 | Silver . | |
| 1,406,699 | 2/1922 | Stewart . | |
| 1,498,470 | 6/1924 | Mignon | 132/83 |
| 1,534,871 | 4/1925 | Roystone | 132/83 R |
| 1,537,591 | 5/1925 | Dodson | 132/83 R |
| 1,557,608 | 10/1925 | Perkins . | |
| 1,689,787 | 10/1928 | Kupferschmid . | |
| 2,031,853 | 2/1936 | Potts . | |
| 2,132,746 | 10/1938 | Meyer . | |
| 2,138,873 | 12/1938 | Meyer . | |
| 2,198,880 | 4/1940 | Meyer . | |
| 2,215,480 | 9/1940 | Sampson | 132/83 R |
| 2,234,634 | 3/1941 | Ramsey et al. . | |
| 2,283,988 | 5/1942 | Heath . | |
| 2,490,650 | 12/1949 | Reckler | 401/6 |
| 2,569,469 | 10/1951 | Gersten et al. . | |
| 2,704,598 | 3/1955 | Casey . | |
| 2,770,071 | 11/1956 | Endres . | |
| 2,800,673 | 7/1957 | Lazisky | 401/6 |
| 2,859,867 | 11/1958 | Shotton . | |
| 2,900,757 | 8/1959 | Grimm, Jr. . | |
| 2,928,537 | 3/1960 | Stagner . | |
| 2,963,147 | 12/1960 | Stagner . | |
| 3,019,548 | 2/1962 | Nadler . | |
| 3,100,363 | 8/1963 | Staver . | |
| 3,125,824 | 3/1964 | Staver . | |
| 3,149,188 | 9/1964 | Schmitt . | |
| 3,162,885 | 12/1964 | Tanner . | |
| 3,192,894 | 7/1965 | Staver . | |
| 3,204,601 | 9/1965 | Staver . | |
| 3,262,421 | 7/1966 | Staver . | |
| 3,286,686 | 11/1966 | Staver . | |
| 3,288,104 | 11/1966 | Staver . | |
| 3,288,105 | 11/1966 | Staver . | |
| 3,453,056 | 7/1969 | Motsavage et al. . | |
| 3,597,098 | 8/1971 | Kellis | 401/6 |
| 3,697,111 | 10/1972 | Thompson . | |
| 3,860,348 | 1/1975 | Doyle . | |
| 4,053,242 | 10/1977 | Mast, Jr. . | |
| 4,062,792 | 12/1977 | McNabb . | |
| 4,235,557 | 11/1980 | Hayes . | |
| 4,244,470 | 1/1981 | Burnham . | |
| 4,335,007 | 6/1982 | Owens . | |
| 4,459,058 | 7/1984 | Bennett . | |

OTHER PUBLICATIONS

Avon Pavi Elle Moisture Touch Body Conditioner, Jan. 1985.

*Primary Examiner*—Gregory E. McNeill

*Attorney, Agent, or Firm*—Elliot M. Olstein; Raymond J. Lillie

[57] ABSTRACT

A solid personal care product is packaged in a container having a cover and handle, with the personal care product being attached to a gripping plate on the cover for removal from the container with the cover. The gripping plate preferably includes a porous member which is impregnated with a portion of the solid product to firmly grip the solid product for removal with the cover.

14 Claims, 5 Drawing Figures

PACKAGE AND APPLICATOR FOR SOLID PRODUCT

This invention relates to a package, and more particularly to a package for a personal care product.

Personal Care products such as deodorant, antiperspirant, and the like have been packaged in various forms. Such forms have included "roll on"; sticks, and aerosols.

Although personal care products have been marketed in such forms, there is a need for improved packaging of personal care products, which are used in a solid form.

In accordance with one aspect of the present invention, there is provided a package for a solid personal care product, in which the package is comprised of a receptacle or container for the solid product and a removable cover to which the solid personal care product is attached, whereby the personal care product is removed from the container with the cover. The cover is provided with means for comfortably holding the cover, such as a handle, whereby the cover functions as a hand held applicator for application of the solid personal care product.

The cover is provided with a support or gripper member, generally in the form of a plate, with the solid personal care product being supported by such support plate. In particular, the support plate has a first surface facing the cover, and a second opposite surface, which faces the container, with the solid product extending outwardly from the second surface.

In one embodiment, the solid personal care product extends outwardly from and covers the second surface of the support plate, and extends through openings in the support plate into the open space between the support plate and cover. The solid product covers at least a portion of the first surface of the support plate.

In another embodiment, which is particularly preferred, the second surface of the support plate has a porous member attached thereto and a portion of the solid product extends into pores of the porous member and is held or gripped by the porous member for removal from the container.

In this manner, the solid personal care product is firmly gripped and supported by the removable cover, whereby the cover may be employed as a hand held applicator for the product.

In accordance with yet another aspect of the present invention, a solid product is attached to a support member through a porous member attached to the support member, with the porous member being impregnated with a portion of the solid product to hold and grip the solid product.

In accordance with an embodiment, the surface of the support plate, including openings or holes, which faces the cover is provided with a plurality of generally vertically extending members in the form of vanes or ribs, which extend from such surface toward the cover, and which function to increase the gripping power of the support plate. Such vertically extending members resist any horizontal shear force which is exerted against the solid product.

In such an embodiment, the surface of the gripper plate or portion thereof which faces the cover holds the product to prevent the product from being pulled outwardly away from the plate, and the vertically extending members resist or prevent movement of the product across the plate by a shearing action. In this manner, the solid product is more securely gripped and held by the cover, thereby facilitating use of the cover as an applicator for the solid product.

In another embodiment, the gripper or support plate is provided wtih vertically extending members in the form of walls which are positioned on the first surface of the plate facing the cover, and which surround the openings in the plate. The surrounding wall is spaced from an opening by a distance to provide a first surface portion between the opening and surrounding wall. In this manner, the solid product is supported by the gripper plate in a manner such that the solid product extends through the openings to a level below the top of the walls surrounding the holes, whereby the solid product covers only the portion of the first surface of the plate between an opening and its surrounding wall. In this manner, the amount of product which is between the cover and plate is reduced, thereby reducing the amount of product which is not available to a user.

The solid personal care product in the package is generally referred to as is a "hot fill" product; i.e., the product is placed into the package in a free flowing or molten form, and is then solidified in the package. As a result, the cover and/or the container may be provided with a fill hole to permit filling of the container with the product in molten form which product is subsequently solidified in the package. The product may be any one of a wide variety of solid personal care items such as a deodorant and/or antiperspirant, a soap, a moisturizer, etc.

In the embodiment which employs a porous member for gripping or holding the solid product, a product portion, in molten form, enters the interstices or pores of the porous member and is solidified therein to form a solid product having a portion within the porous member to provide a firm gripping attachment to the solid product.

The present invention will be further described with reference to the accompanying drawing, wherein.

Figure 1:
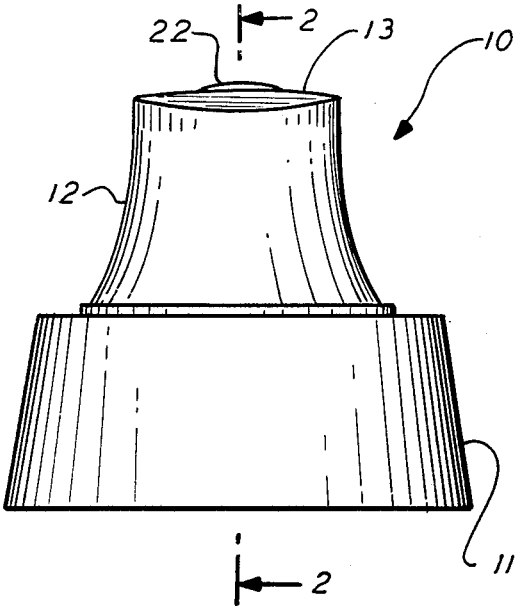
FIG. 1 is a side elevation view of an embodiment of the present invention.
Figure 2:
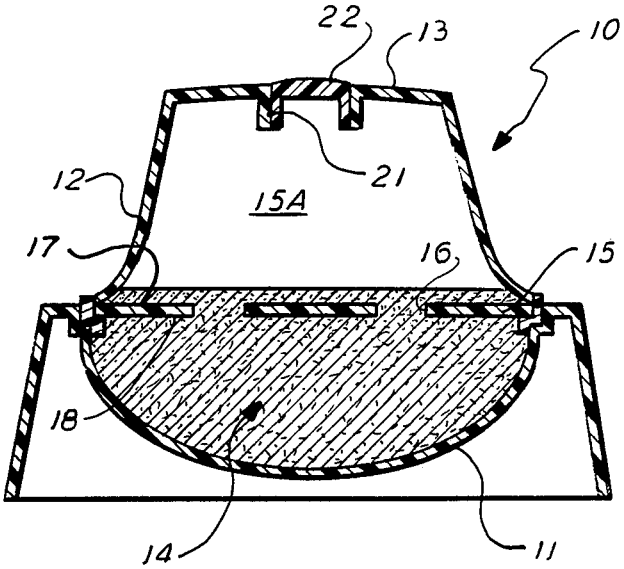
FIG. 2 is a sectional view taken along line 2—2 of FIG. 1.

Referring now to of the drawings, there is shown a package, generally designated as 10 for a solid personal care product, such as a deodorant.

The package 10 is generally comprised of a container or base receptacle 11, and a cover 12, including means for holding the cover 12, in the form of a handle 13. A solid personal care product 14 is attached to cover 12, and is removed from the container 11, with the cover 12. The solid product is attached to cover 12 by means of a gripper or support plate 15 attached to the cover, which support plate 15, in conjunction with the cover 12, defines an open space 15 A.

The support plate 15 includes a plurality of openings or holes 16 through which the solid product 14 extends, whereby the solid product 14 partially fills the space 15 A between cover 12 and plate 15, and overlies surface 17 thereof. The solid product 14 extends outwardly from the plate 15 into the container 11, and covers surface 18 of plate 15.

In this manner, the cover 12 may be removed from the container 11 by means of handle 13, and removal of the cover 12 also removes the solid product 14 from containers 11. The solid product 14, free of the container, may be applied by using the cover 12 as an applicator.

The cover 12 may be removeably connected to the container 11 by any of a variety of means, such as, for example, a snap fit. Similarly, the gripper plate 15 may be connected to cover 12 by any of a variety of means; for example, the cover and gripper plate may be attached by a snap fit.

The cover 12 is provided with a fill hole 21, which is closed by a plug 22. The solid product is introduced through the fill hole 21 in molten form to a level whereby the product extends into the open space 15 A and covers surface 17 of the plate 15. The product is solidified in the container. The hole 21 is closed by plug 22.

Alternatively, the container 11 may be provided with a fill hole, and plug for introducing and forming the solid product in package 10. In this manner, the solid in molten form, is introduced into the package 10 through the container 11, rather than through the cover 12.

The level of solid product on plate 15 is sufficient to securely attach the product to the plate 15, consistent with minimization of such level of product so as to reduce the amount of product which is not available for use.

Figure 3:
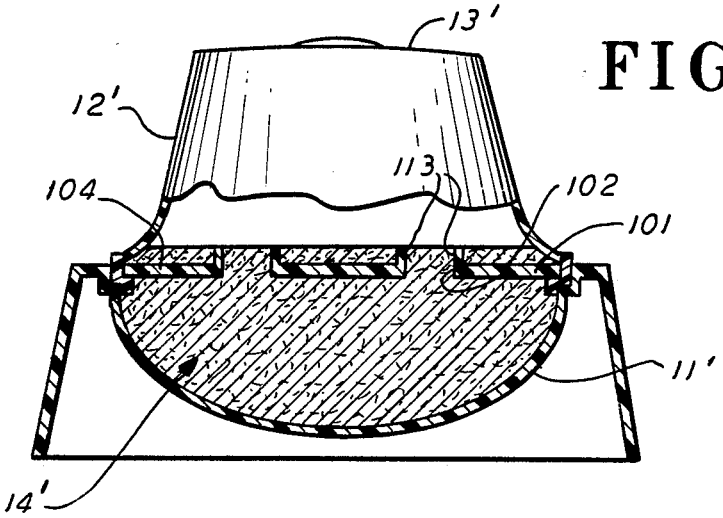
FIG. 3 is a front elevation view, partially in section of another embodiment of the present invention.

An alternative embodiment of the package is shown in Figure 3 of the drawings wherein like parts are designated by like prime numerals. The embodiment of FIG. 3 employs an alternative and preferred gripper or support plate for attaching a solid personal care product to the cover of a package.

As shown in FIG. 3, the gripper plate 101 of the package 10' has a plurality of openings 102, as well as generally vertically extending members in the form of vanes or ribs 113, which extend toward the cover 12'. The openings 102 may be of the same size or shape or may be of different sizes and shapes. The vanes 113 extend into the solid product above the top surface of the plate 101 and provide additional gripping by resisting or preventing horizontal movement of the solid product; i.e., the vanes 113 resist any shearing force exerted against the solid product. Thus, the surface 104 of the plate 101, which faces cover 12', provides support for the solid product to resist movement of the product outwardly from the plate 101, and the vanes 113 provide support for the product by resisting product movement across surface 104 of plate 101.

The vanes 113 can extend in the same or different directions. Similarly, each of the vanes 113 may extend over a portion of the top surface of plate 101 or some or all of the vanes may extend over the entire surface.

In this manner, solid product is firmly attached to cover 12', whereby the cover 12' may be employed as an applicator for applying the solid product.

Figure 4:
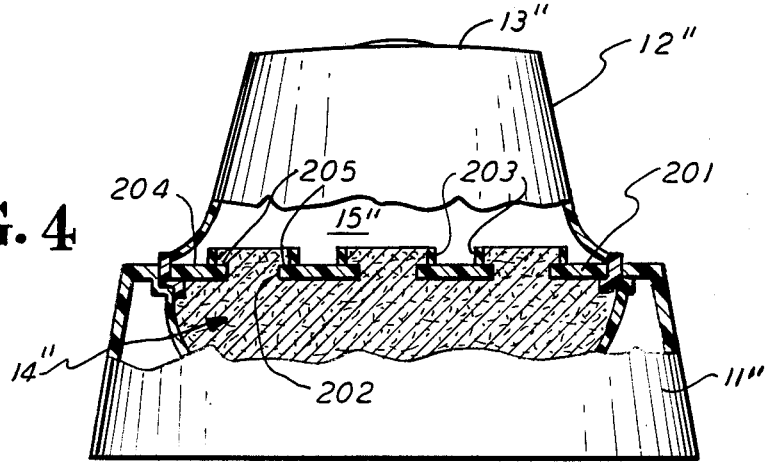
FIG. 4 is a front elevation, partially in section, of a further embodiment of the present invention.

Another embodiment of the present invention is shown in FIG. 4 of the drawing wherein like parts are designated by like double prime numerals. The embodiment of FIG. 4 includes another form of the gripper plate.

Referring to FIG. 4 of the drawing, the gripper or support plate 201, includes a plurality of openings 202, and at least a portion of such openings, and preferably all of the openings, are provided with generally vertically extending walls 203, which are positioned on surface 204 of plate 201 and surround the openings 202. The walls 203 are spaced from the openings 202 by a distance whereby a portion 205 of the surface 204 is between the walls 203 and openings 202.

In this embodiment, the solid product extends through the openings 202 into the space 15" between the plate 201 and cover 12" to a height which is below the top of walls 203. As a result, the solid product covers the portion 205 of surface 204 of plate 201, and the remaining portion of surface 204 is free of product.

In this embodiment, the portion 205 of plate 201 resists movement of product away from plate 201, and the walls 203 resist movement of the product across the surface 204 of plate 201.

As should be apparent, in this embodiment, the amount of product which is between plate 201 and cover 12' is reduced (only a product 205 of the surface 204 is covered with product), thereby reducing the amount of product which is not available to a user.

In accordance with a particularly preferred embodiment, as hereinafter described with reference to FIG. 5 of the drawings, a solid product is attached to the cover for removal from the container by use of a porous member, and in particular, a foam.

Figure 5:
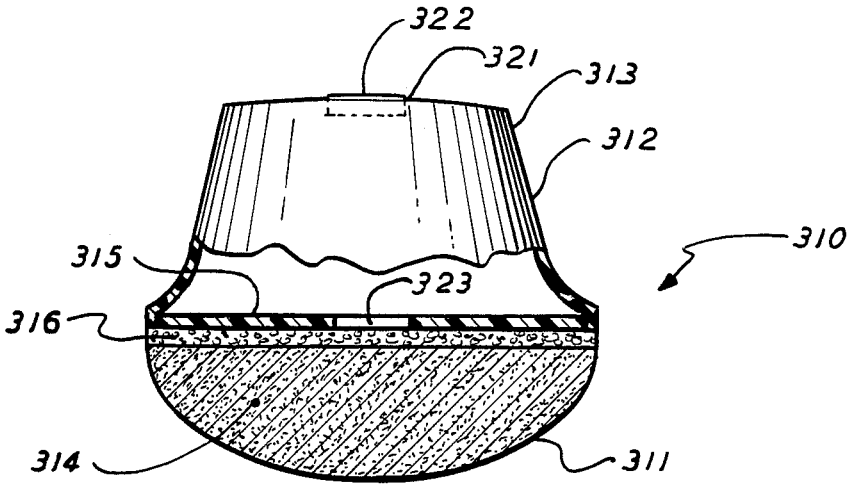
FIG. 5 depicts a particularly preferred embodiment.

Referring now to FIG. 5 of the drawings, there is shown a package, generally designated as 310 for a solid personal care product, such as a deodorant.

The package 310 is generally comprised of a container or base receptacle 311, and a cover 312, including means for holding the cover 312, in the form of a handle 313. A solid personal care product 314 is attached to cover 312, and is removed from the container 311, with the cover 312. The solid product is attached to cover 312 by means of a gripper or support plate 315, attached to the cover 312.

The support plate 315, on the surface thereof facing the container 311, includes a porous member, generally indicated as 316, with porous member 316 being directly attached to the support plate 315. A portion of the solid product 314 extends into the pores or interstices of the porous member for holding and gripping of the solid product. The solid product 314 extends outwardly from the plate 315 into the container 311, and as a result of the attachment to the cover 312, through the porous member 316 and support plate 315, the solid product may be removed from the container with the cover 312.

The cover 312 is provided with a fill hole 321, which is closed by a plug 322. The support plate 315 also includes fill holes, such as hole 323. The solid product is introduced through the fill hole 321 in molten form and flows through the fill hole 323 into the container 311. The solid product, in molten form, is filled to the level of the support plate 315, whereby a portion of the solid product, in molten form, fills the pores of the porous member 316. Upon solidification, a portion of the solid product 314 is dispersed throughout the internal surface area of the porous member 316, and the internal surface area of the porous member 316 holds and grips the solid product, thereby attaching the solid product to the support plate 315 and cover 312.

The porous member 316, is preferably a foam, such as a polyurethane foam, and may be attached to the support plate 315, which is preferably formed from a plastic material, by fusing the foam to the plastic under heat and pressure or by adhesive bonding, etc.

Although any one of a wide variety of porous materials may be used, as is hereinabove described, the porous material is preferably an open cell foam, such as polyurethane foam. The porosity of the foam is sufficient to provide an internal surface area for gripping and holding the solid product. In general, the volume of the pores is such as to provide from 10 to 40 pores per inch of material.

In addition, in accordance with a preferred aspect, the thickness of the foam and the porosity thereof is such that the porous material is soft enough that when the solid product gets down to the end thereof, there is presented a flexible impregnated foam for application against the skin, instead of a hard plastic.

Thus, by impregnating the porous material with a portion of the solid care product, and attaching the porous material which is to be impregnated with the solid product to a support plate, which is attached to a cover for the container, it is possible to provide a combination of a solid care product, container and cover, with removal of the cover from the container, also removing the solid care product from the container.

Although the invention has been described with respect to the embodiments of the drawings, it is to be understood that the scope of the invention is not to be limited thereby.

Thus, for example, the embodiment of the drawings may be modified within the spirit and scope of the present invention.

In the embodiment of FIGS. 3 and 4, the generally vertical extending vanes may be arranged other than as particularly described. Similarly, although the vanes are shown as being vertical, the term "substantially vertical" or "vertically extending" is meant to include vanes which extend at an angle with respect to the gripper plate.

The above modifications and others should be apparent to those skilled in the art from the teachings herein.

The present invention is particularly advantageous in that there is provided a package in which product is removed from the package with the cover, and in which the cover may be employed as an applicator for applying the product.

The product is firmly attached to the cover by use of a gripper plate thereby facilitating both removal of the product from the container, and use of the cover as an applicator.

In accordance with a preferred embodiments, such a result is achieved while reducing the amount of product which is not available to a user.

These and other advantages should be apparent to those skilled in the art of teachings herein.

Numerous modifications and variations of the present invention are possible in light of the above teaching and, therefore, within the scope of the claims, the invention may be practiced otherwise then as particularly described.

What is claimed is:

1. A package for a solid product, comprising:

a container; a removable cover for the container, said cover including a gripping handle; a support member attached to the cover, said support member including a plurality of openings, said support member having a first surface facing the cover and spaced therefrom to define an open space between the support member and cover, said support member having a second surface which faces the container; and a solid personal care product in the container, said solid personal care product extending through said openings into said open space and covering at least a portion of said first surface whereby the solid product is held by said support member and is removable from the container with the cover.

2. The package of claim 1 and further comprising a plurality of vertically extending members attached to the first surface and extending into the solid product to resist movement of the solid product across the support member.

3. The package of claim 1 wherein said first surface includes walls surrounding said openings and spaced therefrom to provide a portion of said first surface between the opening and its surrounding wall, and solid product extending through the openings to a level below the top of the surrounding wall.

4. The package of claim 1 wherein at least one of the container and cover includes a fill hole and plug for hot filling of the solid product.

5. The package of claim 4 wherein the solid product is an anti-perspirant.

6. A package for a solid product, comprising:

a container; a removable cover for the container(;) said cover including a gripping handle; a support member attached to the cover, said support member having a first surface facing the cover and a second surface which faces the container; a porous member attached to said second surface of said support member; and a solid personal care product in the container, said porous member being impregnated with a portion of said solid personal care product to grip and hold the solid personal care product for removal from the container with the cover.

7. The package of claim 6 wherein the porous member is a foam.

8. The package of claim 7 wherein the cover and support member include a fill hole for hot filling of the solid product.

9. The package of claim 7 wherein the container includes the solid personal care product at a level up to said support member.

10. The package of claim 9 wherein the solid is an antiperspirant.

11. An article, comprising: a support member; a porous member attached to one surface of said support member; and a solid product attached to said support member, said solid product being attached to said support member by said porous member being impregnated with a portion of said solid product.

12. The article of claim 11 wherein said porous member is a foam.

13. The article of claim 12 wherein said foam has a porosity of from 10 to 40 pores per inch.

14. The package of claim 6 wherein the porous member has a porosity of from 10 to 40 pores per inch.

* * * * *